United States Patent [19]

Pardo

[11] 4,368,840

[45] Jan. 18, 1983

[54] PACKAGING CONTAINER

[75] Inventor: John Pardo, Yonkers, N.Y.

[73] Assignee: Frito-Lay, Inc., Dallas, Tex.

[21] Appl. No.: 250,866

[22] Filed: Apr. 3, 1981

[51] Int. Cl.[3] ..... B65D 1/24

[52] U.S. Cl. ..... 229/2.5 R; 206/45.33; 206/564; 220/23.8

[58] Field of Search ..... 229/2.5 R, 29 M, DIG. 12; 220/23.8; 206/45.33, 564, 592

[56] References Cited

U.S. PATENT DOCUMENTS

| | | | |
|---|---|---|---|
| 2,091,126 | 8/1937 | Speer | 229/2.5 R |
| 3,400,873 | 9/1968 | Bessett | 229/2.5 R |
| 3,498,526 | 3/1970 | Edwards | 229/44 |
| 3,542,280 | 11/1970 | Crabtree et al. | 229/15 |
| 3,552,595 | 1/1971 | Gerner | 229/2.5 R |
| 3,786,982 | 1/1974 | Rakes et al. | 229/2.5 R |
| 3,813,025 | 5/1974 | Solomon | 229/2.5 R |
| 3,834,609 | 9/1974 | Congleton | 229/2.5 R |
| 3,874,579 | 4/1975 | Holden, Jr. | 229/2.5 R |
| 3,933,296 | 1/1976 | Ruskin et al. | 229/2.5 R |
| 4,195,747 | 4/1980 | Hare | 220/23.8 |

FOREIGN PATENT DOCUMENTS

| | | | |
|---|---|---|---|
| 1545051 | 5/1979 | United Kingdom | 229/2.5 R |

*Primary Examiner*—William Price
*Assistant Examiner*—Gary E. Elkins
*Attorney, Agent, or Firm*—Bernard, Rothwell & Brown

[57] ABSTRACT

A container for food articles including a tray upon which the articles can be stacked, and opposed side members hingedly secured to the tray to retain the articles in the stacked disposition. The side members are moveable between an open position where the articles can readily be stacked or removed from the tray, and a closed or raised position where the sides are secured in place and the articles are restrained from lateral movement relative to the tray due to the inward shape of the side members. Cooperating means are provided in the lower portion of the inward portion of the side members and in the tray to hold the side members in the raised position. The side members can be formed such that in the closed position they are substantially open along the top to expose the top of the stacked articles, and along the ends or sides a small portion of the articles can be exposed to enable access for insertion of the articles into the container or facilitate their removal. The container can be vacuum molded and can be attached along common edges of the side members of adjacent containers to form a multiplicity of containers in a single molding operation.

2 Claims, 7 Drawing Figures

PACKAGING CONTAINER

BACKGROUND AND DISCUSSION OF THE INVENTION

Containers for food items are multitudinous in number but basically include at least two types where the food items are either maintained in a rather loose or random manner within the container or they are arranged in a particular configuration. When dealing with cookies or other more or less flat articles they are often packaged in a stacked disposition to avoid breakage and maintain consumer acceptance which is enhanced by the orderly arrangement created by presenting the articles in a stacked configuration.

One approach in stacking such items has been to completely enclose one or more stacks of cookies in a package which can be opened at one end such that the cookies when stacked vertically are exposed only at the top for access by the consumer. Often this does not adequately provide protection, and the cookies may readily be damaged. In addition, it may be inconvenient for the user to remove the cookies from this stacked disposition, due to the limited access without mutillating the package at least to some extent. An alternative has been to have these items stacked horizontally where the edges of the articles are exposed to the consumer for easy access to the desired number of items. However, these latter packages are not satisfactory since the edges of the articles are exposed which may result in breakage.

By the present invention containers are provided which not only protect stacked food items, e.g., cookies, in the package from breakage, but provides ready access to the articles in the package. The package is also attractive and presents the articles in a manner that is conducive to sales. The container of the invention includes a tray having inwardly formed sides or receptacle-forming members which are hinged to opposite sides of the tray. These side members can be moved from an open position in which the articles can be readily stacked on the tray to a closed or raised position where the articles are at least partially surrounded by the formed sides to retain the articles in place, primarily with respect to lateral movement on the tray. The sides and tray are provided with cooperating means for holding the sides in the raised, article-holding position. The top of the stacked articles, and preferably a minor portion of the side of the articles, can remain exposed to facilitate insertion or removal of articles from the package and to permit consumers to see a portion of each of the articles. The invention and its advantages can be more readily appreciated by reference to the drawings of preferred embodiments as explained in greater detail below.

DETAILED DESCRIPTION OF THE PREFERRED EMBODIMENTS

Figures 1, 2, 3, 4, 7:
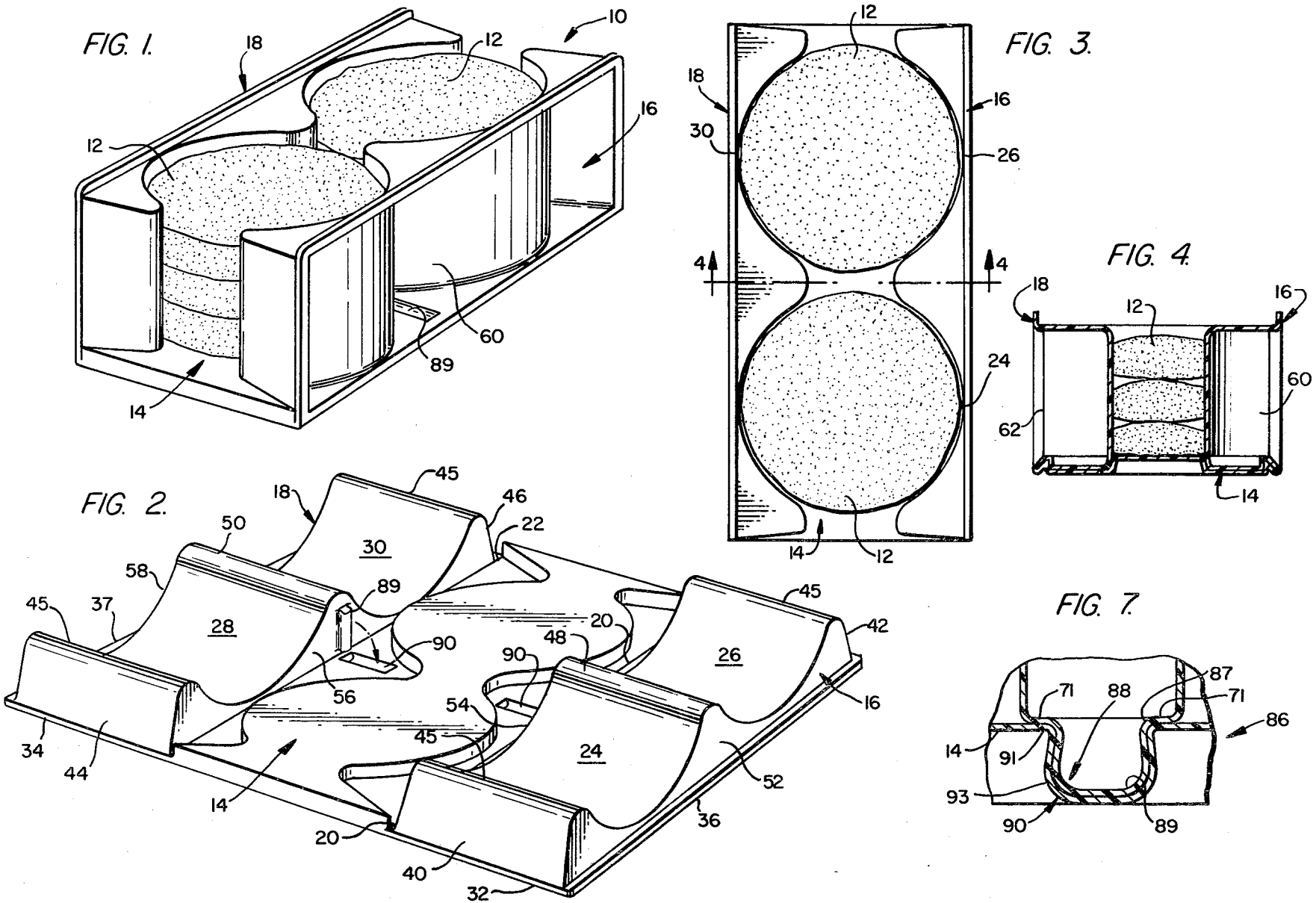
FIG. 1 shows a perspective view of a package having the container of the invention with two stacks of cookies held by the container having its side in the closed or raised position.
FIG. 2 is a perspective view of the container of FIG. 1 where the side portions of the container are in an open position, and the articles to be stacked absent from the tray.
FIG. 3 is a plan view of the package as shown in FIG. 1.
FIG. 4 is an end view of the package as shown in FIG. 3.
FIG. 7 is an enlarged detail of a preferred means for holding the sides of the container in closed or raised position.

As can be seen in FIG. 1, container 10 is configured to retain in this preferred embodiment at least two stacks of cookies 12, portions of which are exposed to the consumer for view, as well as being accessible for withdrawing a cookie or other article from the package. The package includes a tray 14 upon which are stacked cookies 12 in two separate spaced-apart stacks generally centered on the tray 14. Extending from respective, opposed, longitudinal edges of the tray 14 are two sides or receptacle-forming members 16 and 18 which have inwardly-extending portions that provide identations 24, 26, 28 and 30. Sides 16 and 18 are hingedly secured to tray 14 along hinge lines 20 and 22 for moving the side members toward and away from each other and tray 14. In this manner the receptacles 16 and 18 can be moved between an open position as can more readily be seen in FIG. 2 to the closed position of FIG. 1 for at least partially surrounding and containing the cookies or other food items to be packaged against lateral movement. Typically, the container can be formed by vacuum molding. Once formed, the container can be presented in the open position as shown in FIG. 2 and the cookies may be stacked in the middle of the tray 14 opposite the formed indentations in sides 16 and 18. Subsequently, the side members 16 and 18 can be moved to an upright position as can be seen in FIG. 1 such that the so formed receptacles are closely adjacent to or engage portions of the cookies and prevent them from substantial lateral movement relative to tray 14.

Although surfaces of various shapes can be provided in sides 16 and 18 to contain the cookies, the sides in upright position may advantageously form a discontinuous cylindrical surface slightly larger than the circumference of the articles being stacked, in this case substantially circular cookies. In referring to FIG. 2 it can be seen that for packaging the two stacks of cookies each of the folding receptacle-forming sides 16 and 18 includes two adjacent concave surfaces 24 and 26 on side member 16, and concave surfaces 28 and 30 on side member 18 which are spaced from one another on a given side and directly opposed to one another on opposite sides of the tray such that when the sides 16 and 18 are moved into a closed position the opposing concave surfaces 24 and 28 and 26 and 30, respectively, are directly opposed to one another and create a symmetrical package. As shown these surfaces 24, 28, 26 and 30 form part of a cylindrical surface having an arc less than 180°.

As can be seen in FIG. 2 where the container is displayed in an open position the package can have a generally rectangular configuration. Tray 14 is a rectangle whose upper or exposed surface is generally flat with the hinge lines 20 and 22 extending along the entire length of the longer sides of the rectangle. Similarly, sides 16, 18 have rectangular rims 32 and 34, respectively, whose longer dimension is substantially identical to the longer dimension for the tray. One side of the rims 32 and 34 forms the hinge line for each side 16 and 18 along lines 20,22, respectively. Sides 16 and 18 have a width 38 and a length 36 which define a plane from which the other portions of the sides extend. It should be noted that the width 38 is one which is slightly greater than that of the stack of articles to be retained in the package. Although in the preferred embodiment the length 36 is substantially identical to the length of the tray it could be larger or smaller as desired so long as the other functions of the receptacle as discussed above are retained.

The spaced-apart concave surfaces 24 and 26 on side 16, and similar surfaces 28 and 30 on side 18 extend from the plane defined by rims 32 and 34. Connecting the outer edges of concave surfaces 28 and 30, and 24 and 26 to rims 34 and 32, respectively, are end surfaces 40 and 42 for side 16, and 44 and 46 for side 18. These end surfaces are generally flat and may extend more or less perpendicularly from rims 32 and 34. As shown these end surfaces are connected to the ends or edges of their concave surfaces by a curved surface 45 having a relatively small radius of curvature when compared to that of the concave surfaces 24, 26, 28 and 30 to provide a smooth transitional surface where these elements are joined. Similarly, to connect the inner edges or ends of the concave surfaces 28 and 30 and 24 and 26 there is provided for each side an intermediate bridge 48 or 50. In this manner the concave surfaces, along with the end surfaces 40 and 42 and bridge 48 for side 16 and end surfaces 44 and 46 and bridge 50 for side 18, form a continuous surface that is upstanding or projecting from the plane defined by the rim 32 and 34 for each side. When the sides are in the position of FIG. 1 this projection is inwardly toward each other.

In addition, upper and lower lateral surfaces 52 and 54 for side 16, and 56 and 58 for side 18 are provided to close openings in the sides themselves which would otherwise exist between the rim and the concave surfaces. As can be seen from both FIGS. 1 and 2 these lateral surfaces extend throughout the upper and lower edges defined by the concave surfaces 24 and 26, and end surfaces 40 and 42, and bridge surfaces 48 and 50 and the lengths 36 and 37 of the rims 32 and 34. On the other hand undersides 60, 62 are recessed to conform to the upstanding surfaces of sides 16 and 18 described above in connection with FIG. 2. In this manner, the material used in vacuum-forming these surfaces is minimized to reduce the cost in manufacturing the container. The specific embodiment, the material used can be, for example, a polystyrene foam which is vacuum formed to provide the surfaces as shown and described. Together tray 14 and sides 16 and 18 define a cooperating mechanism for locking the sides in the closed or raised position. For this purpose grooves 90 are provided in tray 14 to receive tongues 88 extending from surface 54 and 56 for releasably locking sides 16 and 18 in place. This locking mechanism will be described in more detail in conjunction with FIGS. 5–7 hereinafter.

As can be seen in FIG. 3, the container shown when in a closed disposition partially surrounds the stacked articles to present articles for view and for access by the consumer. For this purpose as can be seen in FIG. 4 the receptacle-forming sides when spaced from one another leave a vertical opening between opposed receptacle sides to allow the consumer to grasp the edge of one or more of the stacked articles.

Figure 5:
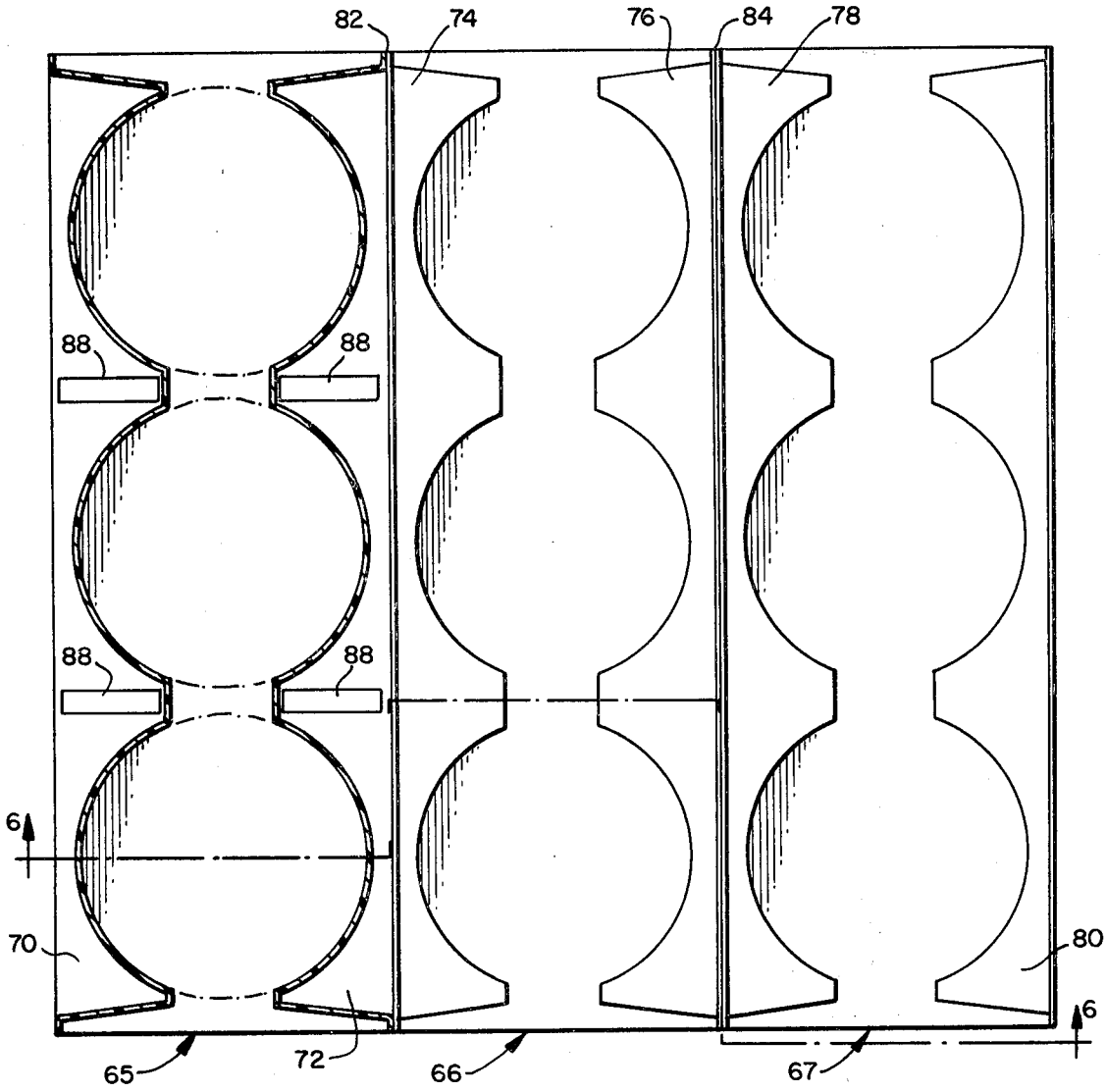
FIG. 5 is a plan view of another embodiment of the invention showing three trays of the invention secured to one another with one tray in section along lines 5—5 of FIG. 6.
Figure 6:
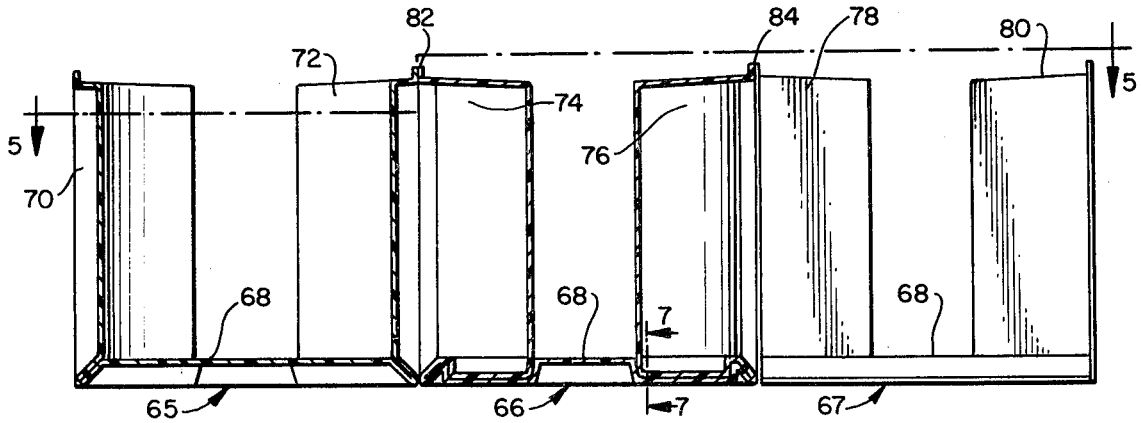
FIG. 6 is a cross sectional view of FIG. 5 taken along lines 6—6.

Another embodiment of the invention is shown in FIGS. 5, 6 and 7 where a series of trays 65, 66, 67 are connected together and each tray has three concave surfaces on a given receptacle-forming side 70, 72, 74, 76, 78, or 80 to contain three stacks of items enabling the entire package to contain 12 stacks of cookies. This embodiment is substantially identical to the embodiment described above except for the number of stacks which can be contained, variations on the tray configuration and the number of trays which can be formed in a single forming process to make a single package. Referring to FIG. 6, it can be seen that each tray defines offset portion 68 which extends slightly above the plane of the tray to define a seat or support for the stack of cookies. The offset portion is circular in configuration having a diameter slightly less than the distance between any two opposing points on the concave surfaces of opposing sides.

As can be seen in FIG. 6 adjacent receptacle-forming sides are hinged along upper edges 82, 84 to provide a three tray system which can be formed in a single vacuum molding step. Once formed the sides are simply folded into the desired closed position as shown in FIG. 6 with the innermost tray having its side member adjacent one side of each of the outer trays.

There is provided an interlock mechanism 86 which includes a tongue 88 extending downwardly from the sides for engagement with a groove or recess 90 extending below the upper surface of the tray between the positions of the stacked articles. As can be seen more clearly in FIG. 5, the recesses 90 are positioned in the raised center on tray 68 and, include a slot having its longest dimension extending transversely from the length of the tray and located midway between the product stacks. The complementary, resilient tongue shown in detail in FIG. 7 can be pressed into the groove to maintain the sides locked in the closed configuration until they are removed by pulling of an operator. The tongue 88 has a length slightly less than or equal to that of a complementary, resilient groove and extends downwardly from an underside or lower lateral surface of a side.

In cross-sectional the tongue and groove are configured to permit the tongue when pressed to be snaplocked high in the groove to retain the sides in a closed disposition. As can be seen more clearly in FIG. 7, tongue 88 includes a bulb portion 89 and neck 87 connecting bulb 89 to lateral surfaces 71 of the sides, and having a cross-sectional width dimension smaller than the effective diameter or width of the bulb 89. Recess 90 defines a complementary bulb 93 and complementary neck 91 to receive the corresponding tongue 88. Complementary neck 91 as shown in FIG. 7 lies above complementary bulb 93 in the tray to provide an impediment to bulb 89 which has the larger cross-sectional dimension. Bulb 89, however, is made sufficiently flexible that under pressure it will deform sufficiently the pass the complementary neck. Upon continued application of downward pressure by a user bulb 89 will completely pass the complementary neck 91 and assume its normal shape within complementary bulb 93. Complementary neck 91 engages neck 87 above bulb 89. In this position tongue 88 is locked into groove 90 until removed, by reversing the procedure discussed above, to disengage interlock mechanism 86. In this manner once the cookies are stacked in place the sides can be moved upwardly about the hinge line and snapped into place by forcing the tongue 88 into the groove 90.

The package described above can be further packaged in another box, carton flexible packaging if desired or otherwise required for sale or transport. For handling, display and maintenance of freshness of the food product, the container and its contents can be enclosed and held by transparent or other wrapping material such as film.

The container of the invention is one which can be readily manufactured by vacuum forming while enhancing the function of the package for containing and displaying stacked food articles. The container protects the articles from damage while simultaneously providing easy access for the consumer in a manner which is attractive to the consumer.

I claim:

1. A one piece foldable packaging container for protecting fragile articles carried thereby, the container being formed from a one piece sheet of plastic material and comprising:

(a) a generally rectangular tray portion of the sheet;

(b) a raised bottom extending upwardly from the plane of the tray in a portion of the bottom thereof, said portion at least partially conforming to the shape of the articles to be carried and protected;

(c) a pair of hinges in the sheet, one along each side of the tray;

(d) a pair of side portions of the sheet connected to the tray portion by the hinges;

(e) article protecting areas in the side portions raised from a plane of the sheet and forming at least a pair of article protection projections in each side portion, the projections forming a pair of cylindrical recesses with a diameter slightly larger than the articles to be protected connected by a bridging bulge;

(f) an arrangement for locking each side wall portion in a position perpendicular to a plane of the tray, the locking arrangement comprising:

(i) bulbous tongue and widening groove locking elements;

(ii) one of the locking elements being on the sides of the tray adjacent the hinge line, and (iii) the other of the locking elements being on each side portion and positioned under the bridging bulge to mate with the portion in the tray when the plane of the side portion is perpendicular to the plane of the tray portion to lock such portion in such position and protect contents.

2. A one piece foldable packaging container for protecting fragile articles carried thereby as defined in claim 1, wherein the one piece sheet of plastic material is sufficiently wide so as to incorporate at least two such containers, and hinge means in the sheet to hinge the top of one side wall portion of one container to a side wall portion of another identical container formed from the same sheet.

* * * * *